United States Patent [19]

Hipkins

[11] Patent Number: 4,597,813

[45] Date of Patent: Jul. 1, 1986

[54] METHOD OF MAKING A REINFORCED PREFORMED BUILDING WALL

[76] Inventor: Jim L. Hipkins, Box 165A, K-3, Fort Worth, Tex. 76140

[21] Appl. No.: 652,964

[22] Filed: Sep. 21, 1984

[51] Int. Cl.[4] ..... B32B 31/06

[52] U.S. Cl. ..... 156/79; 52/204; 52/309.7; 52/309.11; 156/91; 264/46.7; 428/223; 428/309.9

[58] Field of Search ..... 52/204, 207, 309.7–309.11; 156/79, 91; 264/46.7; 428/223, 309.9

[56] References Cited

U.S. PATENT DOCUMENTS

| | | | |
|---|---|---|---|
| 3,472,728 | 10/1969 | Hitch | 52/309.7 X |
| 3,484,331 | 12/1969 | Betz | 52/309.7 X |
| 3,579,937 | 5/1971 | Lukens | 264/46.7 X |
| 3,598,686 | 8/1971 | Clark | 52/309.7 X |
| 3,834,962 | 9/1974 | Strumbos | 156/79 |
| 4,068,429 | 1/1978 | Moore | 52/204 |
| 4,078,348 | 3/1978 | Rothman | 52/309.7 |
| 4,236,361 | 12/1980 | Boden | 52/204 |

*Primary Examiner*—Robert A. Dawson

*Attorney, Agent, or Firm*—James E. Bradley

[57] ABSTRACT

A prefabricated building wall is particularly suited for residences. The wall has a metal outer frame, and inner frames of metal may be located therein for doors and windows. Non-metallic stiffening members are interconnected within the outer frame in a diagonal grid. Hardenable plastic foam is injected into the frame to serve as insulation and support. The stiffening members are I-beams with apertures along their webs to allow them to be interlaced.

6 Claims, 9 Drawing Figures

METHOD OF MAKING A REINFORCED PREFORMED BUILDING WALL

BACKGROUND OF THE INVENTION

1. Field of the Invention

This invention relates in general to building walls, and in particular to a wall that is preformed at a manufacturing site.

2. Description of the Prior Art

Most residences are constructed by pouring a slab, then erecting a wooden frame. Exterior siding is placed on the wooden frame. Wiring is placed in the interior of the walls at the site. Then the walls are insulated and covered on the interior with wallboard. The wallboard is often taped, bedded, textured and painted.

Because nearly all of the work is performed at the site, a number of skilled workers are required at different times. Carpenters, electricians, painters and others must perform their different tasks on the walls and in the residence as it is being constructed. The cost of skilled labor at the site has contributed to the drastic increase in the cost of residential housing in the last few years.

Manufactured housing is available. Normally, the manufactured housing available consists of construction similar to that found in mobile homes. The manufactured house will be partially constructed in a factory, then taken to the site and assembled on a permanent foundation. While these buildings are less expensive, to some, the appearance and the strength appear to be far less than that of a conventionally built residence.

SUMMARY OF THE INVENTION

A building panel and method of constructing a building using such a wall are disclosed in this specification. The building wall is manufactured by using a metal rectagular frame to define the perimeter of the wall. Stiffening members which are resilient to some extent are secured within the frame in a diagonal pattern. Preferably, the stiffening members have apertures spaced along their lengths so that they can be interlaced to form the diagonal pattern. After wiring is put in place, a pastic hardenable foam is poured into the frame.

The stiffening members preferably have an I-beam shape. In forming a ceiling panel, the stiffening members are laid between wooden beams, perpendicular to the beams. Hardenable plastic foam encases the wooden beams and stiffening members to define the ceiling.

CONSTRUCTION OF THE PREFERRED EMBODIMENT

Figure 1:
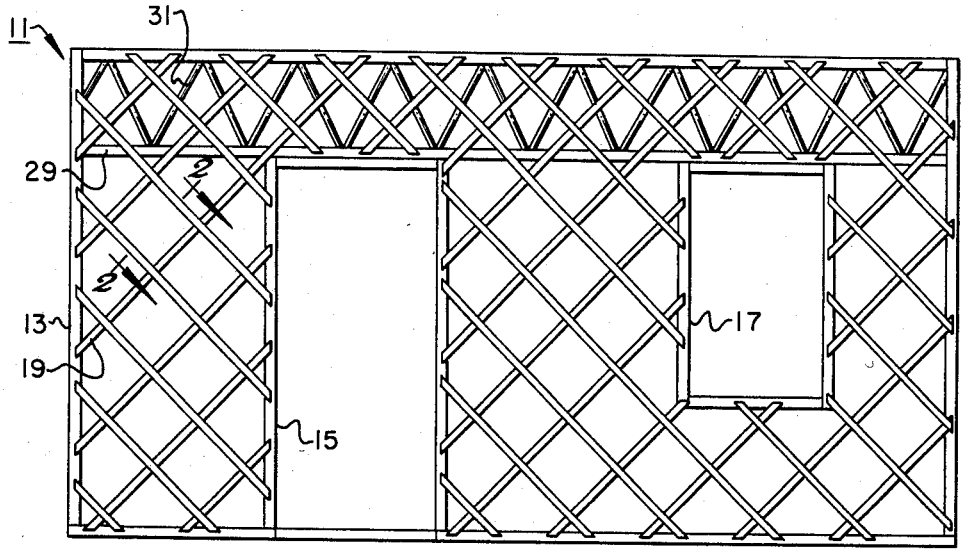
FIG. 1 is a front view of an exterior building wall shown prior to introducing plastic foam.

Referring to FIG. 1, a wall panel 11 is shown during an assembly stage. Wall panel 11 will be fabricated at a factory on a horizontal floor (not shown). Wall panel 11 incudes a metal outer frame 13 which extends around the perimeter of the wall panel 11. The particular wall panel 11 shown in FIG. 1 is for use as an exterior wall, and it also will include a door. A metal frame 15, defining the perimeter of the door is located within the outer frame 13. Also, one of more window frames 17 may be located in the outer frame 13. Door frame 15 and window frame 17 also are comprised of steel metal members.

Figure 2:
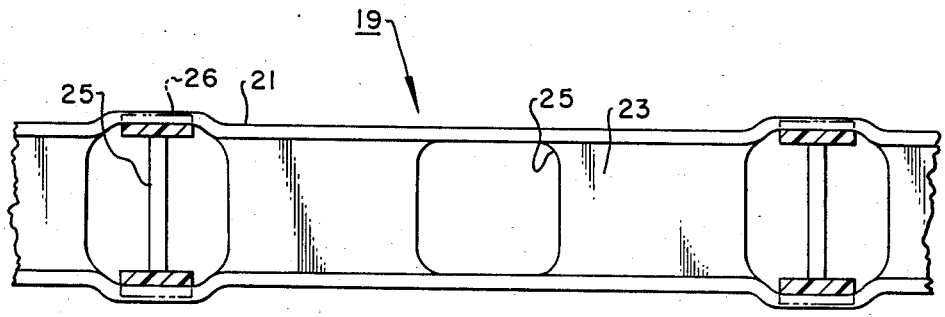
FIG. 2 is an enlarged sectional view of the stiffening members of the wall of FIG. 1, taken along the line II—II of FIG. 1.
Figure 3:
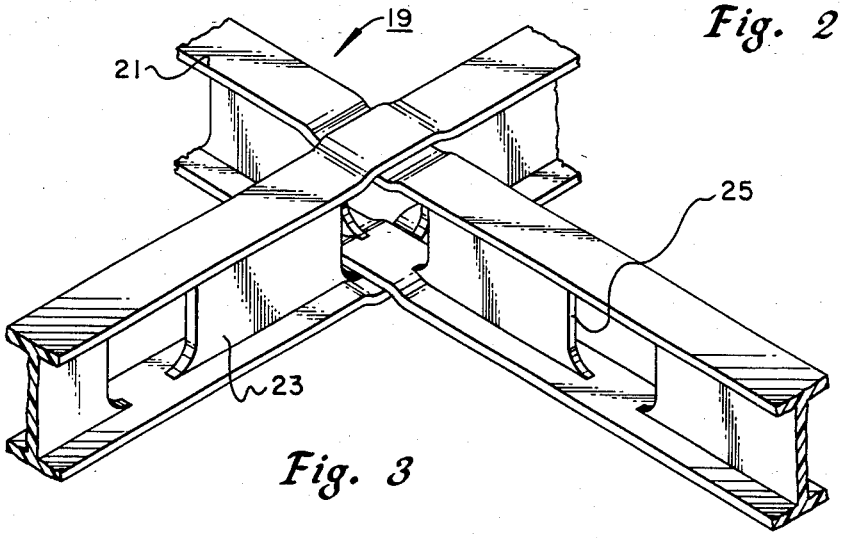
FIG. 3 is a perspective view of the portion of the stiffening members shown in FIG. 2, and shown removed from the frame of FIG. 1.

A plurality of stiffening members 19 are secured within the outer frame 13 in a diagonal pattern. Referring to FIGS. 2 and 3, each stiffening member 19 is a resilient, non-metallic member, such as formed of fiberglass. Each stiffening member 19 is preferably in the shape of an I-beam having parallel flanges 21, separated by a web 23 perpendicular to the flanges. The web 23 contains a plurality of rectangular apertures 25 with rounded corners and spaced throughout the length of each stiffening member 19.

In forming the diagonal pattern, the resiliency and the thinness of the stiffening members 19, allow them to be interlaced as shown in FIGS. 2 and 3. Although all of the stiffening members 19 have the same cross-sectional dimensions, one being laced into another will deflect inwardly. The stiffening member 19 which is receiving another stiffening member 19, will bulge outwardly. The phantom lines 26 shown in FIG. 2 indicate the deflection. Also, preferably, when laced at the proper point, the inserted stiffening member 19 will have an aperture 25 at the same point as the recipient stiffening member 19. The apertures 25 of each stiffening member 19 will register with each other as shown in FIG. 3. This further allows the compression or deflection of the inserted stiffening member 19.

When interlaced, the stiffening members 19 will intersect each other at 90 degrees. Each will be at 45 degrees with respect to the frames 13, 15 and 17.

Once interlaced, as shown in FIG. 1, the ends of the stiffening members 19 are secured by an adhesive such as epoxy to the various metal frame members 13, 15 and 17. Wiring (not shown) is placed in the outer frame 13 for electrical connections. If necessary, pipes for plumbing will also be interlaced. A hardenable plastic foam 27 (FIG. 4) is poured into the outer frame 13 and around the inner frames 15 and 17 to define the wall panel 11.

The wall panel 11 shown in FIG. 1 is for use on an exterior wall which will not have the support of a brick siding. To add further strength, a square tube 29 is inserted through the aperture 25 of the stiffening members 19 prior to introducing the foam 27. The square tube 29 extends the full width of the wall panel 11 parallel to the upper member of the outer frame 13. Square tube 29 joins the upper members of the door frame 15 and window frame 17. Square tube 29 will be welded to the sides of the outer frame 13, and to the door frame 15 and window frame 17.

Also, a plurality of truss members 31, which are steel solid bars, are inserted through the apertures 25 of the stiffening members 19 between the square tube 29 and the upper member of the outer frame 13. Truss members 31 are welded to the outer frame 13 and to the square tube 29. The truss members 31 lace through the stiffening members 19 in a triangular pattern. Each truss member 31 contacts the upper member of the outer frame 13 between the intersection of two of the stiffening members 19. Similarly, the truss members 31 will be welded to the square tube 29 midway between the intersection of the square tube 29 with two of the stiffening members 19. Load on the upper member of outer frame 13 is transmitted through truss members 31, square tube 29, and inner frames 15 and 17 to the lower member of outer frame 13.

Figure 4:
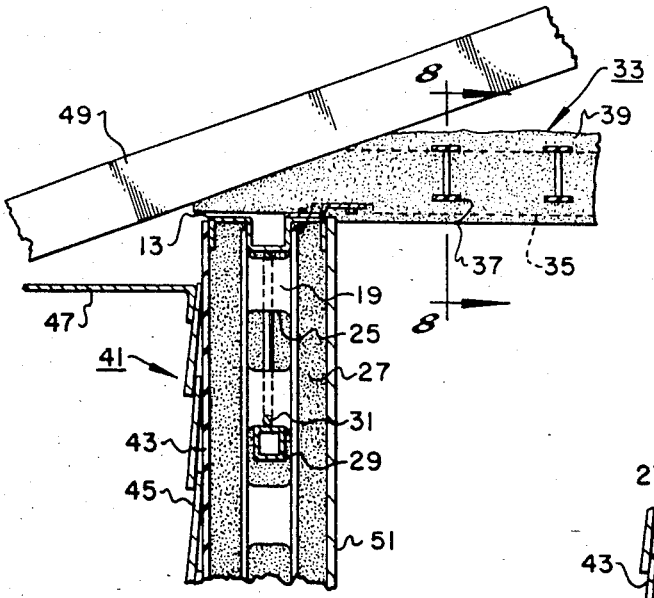
FIG. 4 is a sectional view of the upper portion of an exterior building wall panel constructed in accordance with this invention and shown in a building.
Figure 8:
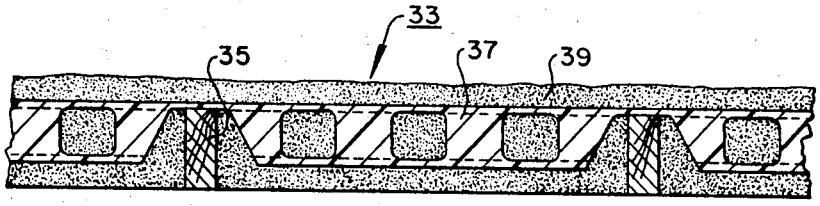
FIG. 8 is a sectional view of the ceiling shown in FIG. 4, taken along the line 8—8 of FIG. 4.

Referring to FIGS. 4 and 8, the ceiling 33 is constructed with parallel wooden beams 35 (FIG. 8). The beams are interconnected with parallel stiffening member segments 37, as shown in FIG. 8. The segments 37 are the same as the stiffening members 19, but they are not interlaced when used in the ceiling. Rather, they contact the beams 35 perpendicular to the beams, forming a rectangular pattern. Hardenable plastic foam 39 is poured over the network of the beams 35 and stiffening member segments 37. The lower surface of the foam 39 provides a uniform textured surface for providing a ceiling without further finishing. Wiring and other electrical fixtures may be placed in the network of the ceiling prior to pouring. The foam 39 will normally be of a less dense material and have less strength than the foam 27.

Referring again to FIG. 4, wall panel 11 is shown constructed into an exterior siding wall 41. Wall 41 is preferably a back wall of a residence. Wall 41 includes a plastic moisture barrier 43, exterior siding 45 and an interior finish panel 51. During manufacturing, the siding 45 and moisture barrier 43 will be placed in the frame 13 (FIG. 1) prior to placing the stiffening members 19. The finish wall 51 will be placed over foam 27 prior to hardening. A complete composite wall is thus formed at the manufacturing site.

Figure 5:
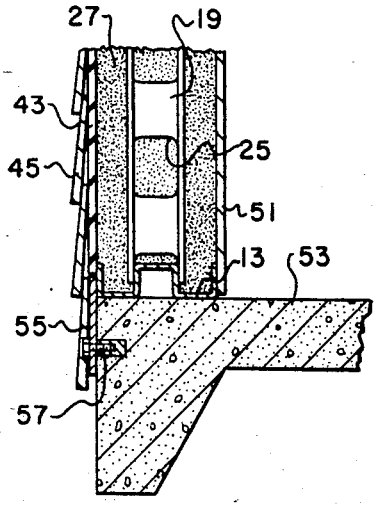
FIG. 5 is a sectional view of the lower portion of the wall of FIG. 4, shown connected to a slab.

At the home site, the completed wall 41 is tilted in place. Eave covers 47 are formed in a conventional manner. Roof 49 will preferably be prefabricated in two main sections and secured to the wall 41. FIG. 5 shows the lower portion of the wall 41. The concrete slab 53 will provide support for the dwelling. A metal plate 55 is bolted to the slab to bolt 57. The lower member of the outer frame 13 is welded to the plate 55 during installation.

Figure 7:
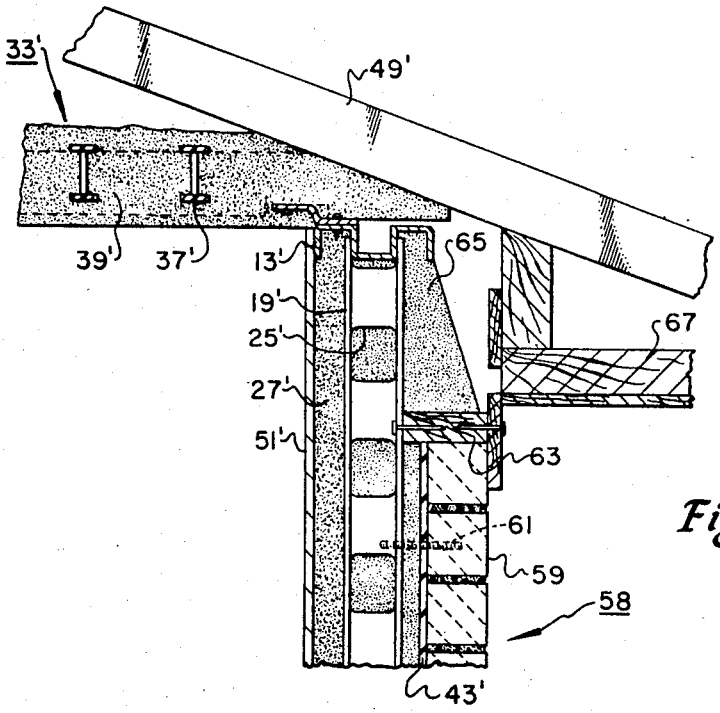
FIG. 7 is a sectional view of the upper portion of the wall of FIG. 6, also showing a part of the building.

FIG. 7 shows a wall having a brick siding 59 instead of siding 43 as shown in FIG. 4. The wall panel 11 for this exterior wall will not need the square tube 29 nor the truss members 31. The common components of this wall with the wall 41 are designated with the same number, but with a prime symbol. Similar to the construction of wall 41, wall 58 is also constructed at the manufacturing site. A mold (not shown) containing guide ribs for positioning of bricks 59 is placed under frame 13' while it is on the floor and prior to placing stiffening members 19' therein. Bricks 59 are placed on the mold and grout is introduced between bricks 59 to hold them in place. Moisture barrier 43' is placed over the bricks 59, and fasteners 61 will protrude upwardly through moisture barrier 43. Then, the stiffening members 19' are placed over the bricks 59 and foam 27' is poured. A finish wall 51' is placed on the foam. After tilting up, more grout is placed between bricks 59 to give a smooth exterior. At the home site, the complete wall 58 is tilted up into position. During forming at the manufacturing site a wooden plate 63 is located on top of the brick siding 59. A foam member 65 is formed extending from plate 63 upwardly to the top of the frame 13'. Member 65 transmits load of the roof 49' to the brick siding 59. Eave support members 67 support the eave of roof 49' in a conventional manner.

Figure 6:
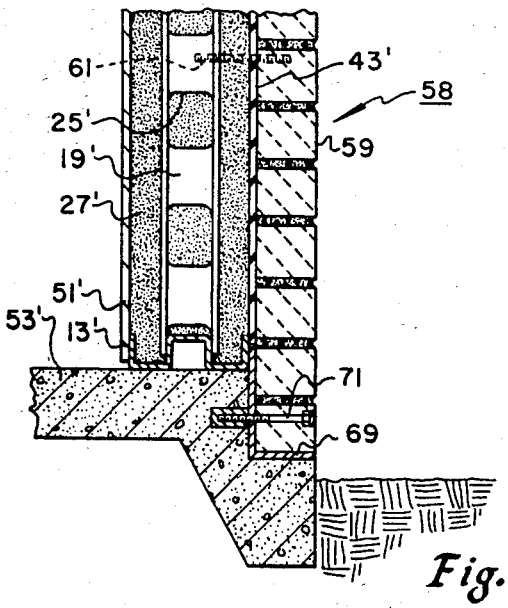
FIG. 6 is a sectional view of a lower portion of another embodiment of an exterior constructed in accordance with this invention and shown mounted to a slab.

FIG. 6 shows the lower portion of the wall 58 of FIG. 7. An anchor plate 69 will be located on the concrete slab 53'. A bolt 71 will secure the brick siding 59 to the anchor plate 69. The lower portion of the outer frame member 13' will be welded to the anchor plate 69. Preferably, the wall 58 of FIGS. 6 and 7 will be located on the front of the dwelling, while the wall 41 of FIGS. 4 and 5 will be located at the rear.

Figure 9:
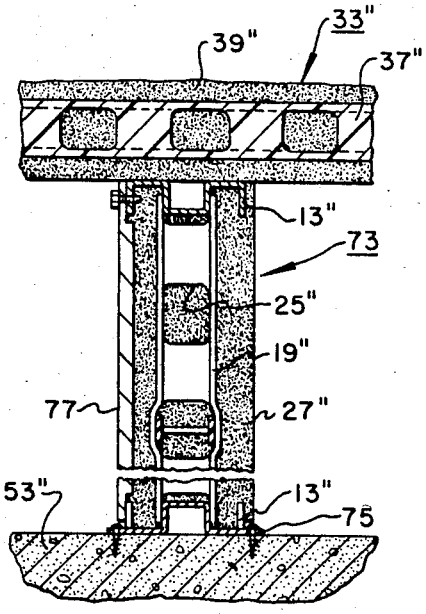
FIG. 9 is a sectional view of an interior wall constructed in accordance with this invention.

FIG. 9 shows an interior wall or partition 73 constructed generally as shown in FIG. 1. The common components of the interior wall 73 with the exterior walls 41 (FIG. 4) and 58 (FIG. 7) are designated with a double prime symbol. The interior wall 73 has stiffening members 19'' but does not need the truss members 31 nor square tube 29 (FIG. 1). The lower member of the outer frame 13'' has tabs 75 that will bend outwardly to be secured by fasteners to the concrete slab 53'. If another partition (not shown) is to be joined to the partition 73 perpendicular to it, a metal channel member 77 is secured to that side. Channel member 77 has a vertical channel (not shown), having the width of the thickness of the partition 73, and formed therein to receive the other partition.

In operation, the various walls 41, 58 and 73 are preformed at the factory as described. The ceiling panels 33 are preformed also, by placing stiffening members segments 37 (FIG. 8) parallel to each other and perpendicular to wooden frame members 35. Foam 39 is poured and allowed to harden. The roof 49 is constructed into two main components in the factory. Then all the components are brought to the home site, which has the slab 53 and electrical wiring and plumbing in place. The walls 41, 58 and 73 are tilted up and secured to the slab 53. The ceiling 33 is placed over the walls 41, 58 and 73. Roof 49 is lowered into place. Fixtures and cabinets can then be brought in and connected into the building. Electrical and plumbing connections are made.

The invention has significant advantages. The wall panels are strong and well insulated. By constructing the panels at the factory, the amount of skilled labor at the home site is greatly reduced. Once the panels and ceiling are positioned, the finish work is not extensive. This should reduce the cost of a new residence substantially.

While the invention has been shown in only one of many forms, it should be apparent to those skilled in the art that it is not so limited but is susceptible to various changes without departing from the scope of the invention.

I claim:

1. A method of forming a building wall, comprising:

providing an outer frame that is located in a plane for defining the perimeter of the wall;

providing a plurality of stiffening members, each stiffening member having slot means for interconnecting with other stiffening members;

interconnecting the stiffening members within the frame in an X-shaped diagonal pattern with the stiffening members located in the plane of and extending to the outer frame;

connecting to the outer frame the ends of the stiffening members which extend to the outer frame to provide reinforcement; then filling the frame with a hardenable plastic foam.

2. The method according to claim 1 further comprising the steps of:

placing within the outer frame at least one inner frame located in the plane of the outer frame and defining a portal, and interconnecting the stiffening members between the inner and outer frames prior to filling with foam.

3. The method according to claim 1 further comprising the steps of:

placing within the outer frame at least one inner frame located in the plane of the outer frame, and defining a portal;

placing a horizontal beam across the frame at the top of the portal;

interconnecting a plurality of metal truss members in a triangular pattern between the horizontal beam and the frame above the portal; and interconnecting the stiffening members between the inner and outer frame and through the truss members prior to filling with foam.

4. A method of forming a building wall, comprising:

providing a rectangular outer frame defining the perimeter of the wall;

providing a plurality of nonmetallic, resilient stiffening members, each stiffening member having a plurality of apertures along its length for interlacing with others of the stiffening members;

interlacing the stiffening members through the apertures within each other in diagonal pattern extending to the outer frame;

connecting to the outer frame the ends of the stiffening members which extend to the outer frame to define a grid within the outer frame; and filling the outer frame with a hardenable plastic foam.

5. A method of forming a building wall, comprising:

providing an outer frame that is located in a plane defining the perimeter of the wall;

providing a plurality of non-metallic, resilient stiffening members of identical cross-sectional dimension, each stiffening member having an I-beam configuration with a pair of parallel flanges separated by a web, the web having a plurality of apertures spaced along the length of the stiffening member for interlacing with other stiffening members;

interlacing the stiffening members by pushing them through the apertures within one another to define a grid with a diagonal pattern located in the plane of and extending to the outer frame;

connecting to the outer frame the ends of the stiffening members which extend to the outer frame; then filling the frame with a hardenable plastic foam.

6. The method according to claim 5 further comprising deflecting each stiffening member in a cross-sectional plane perpendicular to the length of the stiffening member while pushing the stiffening members through the apertures within one another.

* * * * *